US009726453B1

(12) United States Patent
Hamm et al.

(10) Patent No.: US 9,726,453 B1
(45) Date of Patent: Aug. 8, 2017

(54) ARROW REST

(71) Applicants: Brian H. Hamm, Wisconsin Rapids, WI (US); Christopher A. Hamm, Wisconsin Rapids, WI (US)

(72) Inventors: Brian H. Hamm, Wisconsin Rapids, WI (US); Christopher A. Hamm, Wisconsin Rapids, WI (US)

( * ) Notice: Subject to any disclaimer, the term of this patent is extended or adjusted under 35 U.S.C. 154(b) by 0 days.

(21) Appl. No.: 15/341,409

(22) Filed: Nov. 2, 2016

(51) Int. Cl.
*F41B 5/22* (2006.01)
*F41B 5/14* (2006.01)
*F41B 5/10* (2006.01)

(52) U.S. Cl.
CPC ..... *F41B 5/143* (2013.01); *F41B 5/10* (2013.01)

(58) Field of Classification Search
CPC ..... F41B 5/143
USPC ..... 124/44.5
See application file for complete search history.

(56) References Cited

U.S. PATENT DOCUMENTS 5,722,381 A 3/1998 Mizek
5,896,849 A 4/1999 Branthwaite
5,960,779 A * 10/1999 Jessee ..... F41B 5/143 124/44.5
6,178,959 B1 * 1/2001 Troncoso, Jr. ..... F41B 5/143 124/44.5
RE38,096 E 4/2003 Branthwaite
6,561,174 B1 5/2003 Afshari
6,595,195 B1 7/2003 Barner
6,615,813 B1 * 9/2003 Troncoso, Jr. ..... F41B 5/143 124/44.5
6,634,349 B2 * 10/2003 Mizek ..... F41B 5/143 124/44.5
6,681,754 B1 1/2004 Angeloni
6,739,321 B1 * 5/2004 Puchlerz ..... F41B 5/143 124/44.5
6,782,881 B2 * 8/2004 Mizek ..... F41B 5/143 124/44.5
6,789,536 B1 * 9/2004 Summers ..... F41B 5/143 124/44.5
6,792,932 B2 9/2004 Musacchia
6,814,068 B1 * 11/2004 Troncoso, Jr. ..... F41B 5/143 124/44.5
6,823,856 B2 11/2004 Rager
6,904,900 B2 6/2005 Gallops
6,913,008 B2 7/2005 Simo
6,915,791 B2 7/2005 Harwath
6,938,616 B2 9/2005 Walk
7,219,662 B1 * 5/2007 Henry ..... F41B 5/143 124/44.5
7,331,338 B2 2/2008 Mizek
7,409,950 B2 * 8/2008 Ellig ..... F41B 5/143 124/44.5
7,597,095 B2 10/2009 Grace
(Continued)

OTHER PUBLICATIONS

Website screenshot of Bowlfinger Archery Inc. Medusa Max arrow rest at facebook.com; Apr. 21, 2015.
(Continued)

*Primary Examiner* — Alexander Niconovich
(74) *Attorney, Agent, or Firm* — Shane Delsman; Godfrey & Kahn, S.C.

(57) ABSTRACT

An arrow rest that is rotated out of the flight path of an arrow when the arrow is shot. Rotating the arrow rest out of the flight path prevents disruption to the accuracy and speed of the arrow.

20 Claims, 23 Drawing Sheets

(56) References Cited

U.S. PATENT DOCUMENTS

| | | | | |
|---|---|---|---|---|
| 7,681,566 | B2 * | 3/2010 | Mertens | F41B 5/143 124/44.5 |
| 7,717,103 | B2 * | 5/2010 | Johnson | F41B 5/143 124/25.6 |
| 7,963,279 | B2 * | 6/2011 | Harwath | F41B 5/143 124/24.1 |
| 8,333,180 | B2 * | 12/2012 | Mizek | F41B 5/143 124/44.5 |
| 8,434,464 | B1 * | 5/2013 | Terzo | F41B 5/143 124/44.5 |
| 8,474,443 | B2 | 7/2013 | Geno | |
| 8,544,457 | B1 | 10/2013 | Munsell | |
| 8,596,253 | B2 * | 12/2013 | Adams | F41B 5/143 124/44.5 |
| 8,701,643 | B2 * | 4/2014 | Ellig | F41B 5/1438 124/44.5 |
| 8,752,536 | B2 * | 6/2014 | Sims | F41B 5/10 124/24.1 |
| 8,960,174 | B2 | 2/2015 | Khoshnood | |
| 8,967,131 | B2 | 3/2015 | Hunt | |
| 9,004,054 | B2 * | 4/2015 | Khoshnood | F41B 5/143 124/44.5 |
| 9,032,944 | B2 * | 5/2015 | Adams | F41B 5/143 124/44.5 |
| 9,341,433 | B1 * | 5/2016 | Summers | F41B 5/143 |
| 2003/0024516 | A1 * | 2/2003 | Mizek | F41B 5/143 124/44.5 |
| 2006/0157038 | A1 * | 7/2006 | Ellig | F41B 5/143 124/44.5 |
| 2007/0163560 | A1 * | 7/2007 | Mertens | F41B 5/143 124/44.5 |
| 2012/0138035 | A1 * | 6/2012 | Ellig | F41B 5/1438 124/44.5 |
| 2013/0255654 | A1 * | 10/2013 | Nystrom | F41B 5/143 124/44.5 |

OTHER PUBLICATIONS

Website screenshot of AAE D.O.A. arrow rest at facebook.com; Jun. 27, 2014.

* cited by examiner

ARROW REST

FIELD OF THE INVENTION

This invention relates generally to an arrow rest for a bow or other similar type of weapon or equipment. More particularly, the present invention relates to a fall away arrow rest.

BACKGROUND

Arrow rests are attached to bows to provide a surface to support an arrow during loading, drawing and shooting of the arrow. Arrow rests are often attached to a bow above the bow shelf and grip. Some arrow rests also allow for vertical and/or horizontal adjustment of the arrow rest.

There are generally two types of arrow rests, namely stationary arrow rests and fall away arrow rests. Stationary arrow rests do not move after they are attached to the bow and adjusted for accuracy. As the bowstring is drawn and released, the arrow will move away from the bow and through or across the stationary arrow rest. Arrows typically have fletching around the rear of the arrow shaft, or end opposite the arrow head, to help make the flight of the arrow more stable and accurate. As the fletching reaches the stationary arrow rest, the fletching may contact a part of the stationary arrow rest which can affect the accuracy and speed of the arrow.

Another type of arrow rest is called a fall away arrow rest. Fall away arrow rests can often be attached to the bow and adjusted much like stationary arrow rests. However, the part(s) of the fall away arrow rest supporting the arrow is moved away from the flight path of the arrow when the bowstring is released to ensure that neither the arrow nor the fletching contacts the arrow rest.

One example of a fall away arrow rest is the Medusa Max arrow rest made by Bowfinger Archery, Inc., which is shown in FIGS. 1-3. The arrow rest 10 seen in FIGS. 1-3 includes an enclosure 12 that rotatably supports a rod 14. One end of the rod 14 is attached to a launcher 16. The other end of the rod 14 is rotatably supported by the enclosure 12 and is attached to an activator 18. The activator 18 is located in a cavity 20 of the enclosure. A housing cap (now shown) encloses the cavity and has a hole for the rod 14, such that a portion the end of the rod extends out of the housing cap. A wheel (not shown) is attached to the end of the rod 14. A cord (not shown) is attached to the wheel at one end and to the bowstring (not shown) at the second end. When the bowstring (not shown) is drawn, e.g. to shoot an arrow, the bowstring will pull the cord which in turn will rotate the wheel and, thereby, the rod 14. Rotation of the rod 14 will cause rotation of the launcher 16.

An arrow can be loaded on the launcher 16 when the launcher is in the lowered position, as seen in FIG. 1. The launcher 16 may then be moved to the upright position, as seen in FIG. 2 or the arrow may be loaded after the launcher is in the upright position. The launcher 16 can be moved from the lowered position to the upright position by drawing the bowstring (not shown), manually moving the launcher or manually rotating the wheel.

Wrapped around the rod 14 is a torsion spring 22. A first end 24 of the spring 22 is located and held by a slot 26 in the projection 28 of the activator 18. A second end 30 of the spring 36 is held by a slot (now shown) in the cover (not shown) that encloses the cavity 20. The spring 22 urges the activator to rotate clockwise (when describing direction, the direction described is in relation to the view of the referenced drawing(s)) and, thereby, the launcher 16 towards the rest position.

The launcher 16 is selectively held in the ready position in part by the activator 18 and a latch 32. One end of the latch 32 is pivotally attached to the enclosure 12 in the cavity 20. The bottom surface of the latch 32 includes a first arcuate surface 34 and a second arcuate surface 36 separated by a protrusion 38. The activator 18 includes a projection 28 and a shelf 40. The shelf 40 only extends part way up the activator 18 such that the activator can rotate about the rod 14 without interfering with the latch 32.

A pin 42 extends from the shelf 40 of the activator 18. When the launcher 16 is in the rest position, as seen in FIG. 1, the pin 34 does not engage the latch 32 and the latch rests against a part of the enclosure 12. As the activator 18 is rotated counterclockwise, to move the launcher 16 from the rest position to the ready position, the pin 42 engages the first arcuate surface 34.

Continued rotation of the activator 18, against the urging of the spring 22, will cause the pin 42 to engage the second arcuate surface 36. Once the force causing the counterclockwise rotation of the activator 18 is released, the pin 42 will be held by the protrusion 38 against the urging of the spring 22, to hold the launcher 16 in the ready position as seen in FIG. 2.

When the bow (not shown) is drawn, by pulling on the bowstring (not shown), a cord (not shown) connected to the bowstring and wheel (not shown) will rotate the wheel counterclockwise. Because the wheel is attached to the rod 14, rotation of the wheel will cause rotation of the rod. Rotation of the rod 14 will cause rotation of the activator 18 until the projection 28 of the activator contacts the end of the latch 32. As seen in FIG. 3, the shape of the projection 28 and end of the latch 32 are such that when they are in contact the latch is raised off of the pin 42.

The torque from the spring 22 is such that when the bowstring (not shown) is released, the spring will cause the activator 18, and shelf 40 with pin 42, to rotate clockwise faster than gravity will cause the latch 32 to fall. Therefore, the pin 42 will not be caught by the second arcuate surface 36 or the protrusion 38 and the launcher 16 will be returned to the rest position before the fletching of the arrow has passed through the area of the arrow rest. This provides a clear path for the arrow.

The cavity 20 also includes a rubber pad 44 to stop the rotation of the activator 18 when the launcher 16 is being moved to the rest position by the spring 22.

Another example of a fall away arrow rest is the DOA arrow rest made by Arizona Archery Enterprises, Inc., which is shown in FIGS. 4-7. The arrow rest 46 seen in FIGS. 4-7 includes an enclosure 48 that rotatably supports a rod 50. One end of the rod 50 is rotatably attached to and extends through a cavity 52 in the enclosure 48.

A housing cap (not shown) encloses the cavity 52 and has a hole for the rod 50, such that the end of the rod extends out of the housing cap. The end of the rod 50 that extends from the housing cap is attached to a launcher 54. Rotation of the launcher 54 will cause rotation of the rod 50.

An arrow can be loaded on the launcher 54 when the launcher is in the horizontal or rest position, as seen in FIG. 4, and then moved to the ready position, as seen in FIGS. 5-6. The launcher 54 is moved from the rest position to the ready position by pushing down on the thumb latch 56 on the launcher 54.

An activator 58 is attached to the rod 50 in the cavity 52 of the enclosure 48. A spring 60 is located between the activator 58 and the enclosure 48. A first end 62 of the spring 60 is secured to the enclosure 48. A second end 64 of the spring 60 is secured to the activator 58, such that the activator is urged in a counterclockwise direction. A rubber pad 66 is held in a shelf 68 of the cavity 52 such that when the launcher 54 is in the rest position, as seen in FIG. 4, the activator 58 rests against the rubber pad.

A latch 70 is pivotally attached to a wall of the cavity 52. A spring 72 urges the latch 70 into contact with the activator 58. When the activator 58 is rotated clockwise, against the force of the spring 60, the oblong shape of the activator pushes the latch 70 away compressing the spring 72. When the activator 58 is rotated such that the flat end 74 of the activator reaches a notch 76 in the latch 70, the flat end will engage the notch. Because the spring 60 is urging the activator 58 in a counterclockwise direction, the activator 58 is held by the notch 76. Thereby, the rod and launcher 54 are held in the ready position as seen in FIG. 5.

The activator 58 does not extend beyond the plane of the shelf 68 in the cavity 52 so as not to interfere with the hammer 78, seen in FIGS. 6-7, when the activator rotates. The hammer 78 is pivotally attached to the shelf 68 of the cavity 52 by a rod 80. A spring 82 is located between the hammer 78 and the shelf 68. A first end 84 of the spring is secured in a hole of the shelf 68. A second end 86 of the spring 82 is located in a hole in the hammer 78 such that the hammer is urged towards the latch 70. Latch 70 is long enough to engage the activator 58 and be engaged by the hammer 78, but the hammer and activator cannot directly contact each other.

The rod 80 extends through the enclosure 48. A wheel (not shown) is attached to the rod 80 extending out of the enclosure 48. A cord (not shown) is attached to the wheel at one end and to the bowstring (not shown) at the second end. When the bowstring is drawn, e.g. to shoot an arrow, the bowstring will pull the cord which in turn will rotate the wheel and, thereby, the rod 80, clockwise. Rotation of the rod 80 will cause rotation of the hammer 78 away from the latch 70 as seen in FIG. 6.

When the bowstring is released, a cord will release its pull on the wheel and thereby the rod 80. The release of the rod 80 will allow the spring 82 to rotate the hammer 78 towards and into the latch 70. The impact will cause the latch 70 to be pushed down and compress the spring 72. The movement of the latch 70 frees the flat side 74 of the activator 58 from the notch 76 as seen in FIG. 7. This will allow the spring 60 to rotate the activator 58 back towards the rubber pad 66. Because the spring 60 is stronger than the spring 72, the flat side of the activator 58 will rotate past the notch 76 before the latch 70 contacts the activator 58 again. The launcher 54 will therefore, be returned to the rest position before the fletching of the arrow has passed through the area of the arrow rest. This provides a clear path for the arrow.

Other examples of a fall away arrow rest can be seen in U.S. Pat. Nos. 8,701,643 and 6,789,536.

However, such fall away arrow rests suffer from many disadvantages. For example, the above fall away arrow rests are not optimized and require many parts, which increases the cost of the arrow rest due to the cost of the many parts and increased labor costs to install all of the parts. The additional number of parts also increases the risk of malfunction.

Some of the arrow rests, e.g. DOA, make loud clicking noise when moved to the ready position and/or when an arrow is shot and the rest is moved to the rest position. Such noise can scare away prey during hunting. Some arrow rests, rely on gravity, e.g. Medusa Max, and if the bow is not held upright, for example to avoid an obstacle during hunting, or if moisture or debris enter the cavity, the arrow rest may not function correctly.

It will be understood by those skilled in the art that one or more aspects of the foregoing invention can meet certain objectives, while one or more other aspects can lead to certain other objectives. Other objects, features, benefits and advantages of the present invention will be apparent in the descriptions of the disclosed embodiments, and will be readily apparent hereinafter to those skilled in the art. Such objects, features, benefits and advantages will be apparent from the above as taken in conjunction with the accompanying figures and all reasonable inferences to be drawn therefrom.

DETAILED DESCRIPTION

Figure 1:
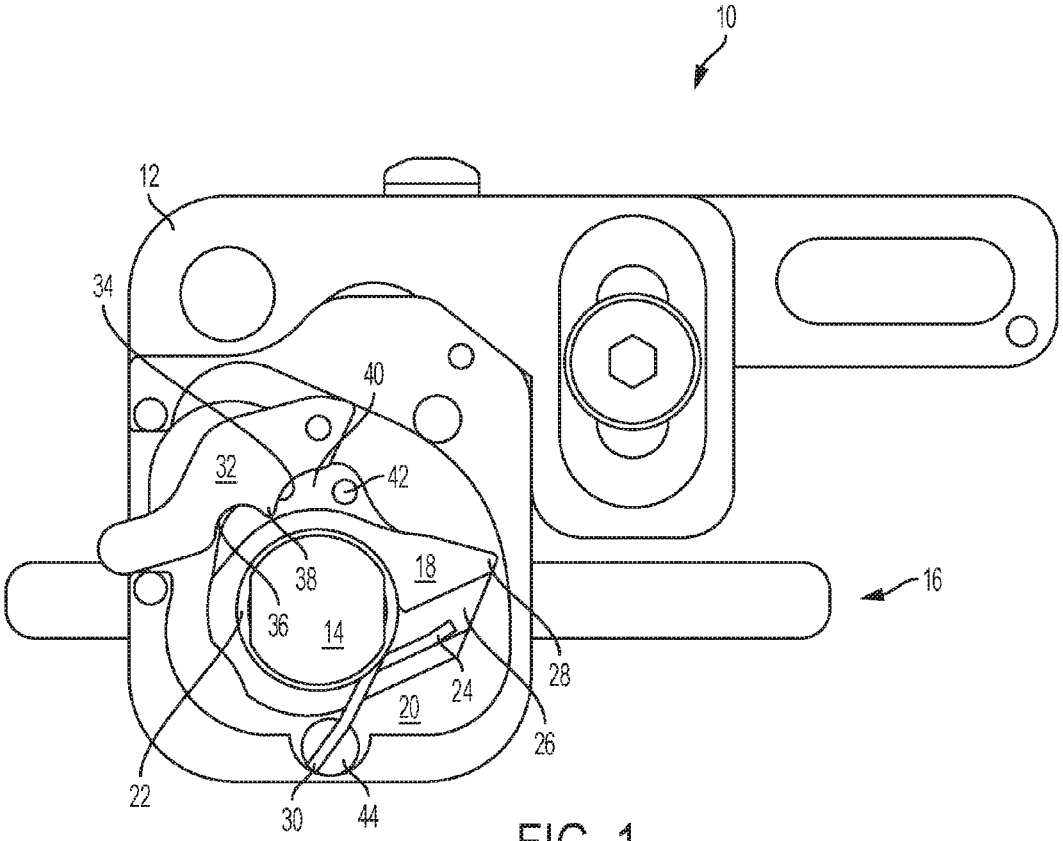
FIG. 1 PRIOR ART
FIG. 1 is an elevation view of a prior art arrow rest in the rest position with the cover removed.
Figure 2:
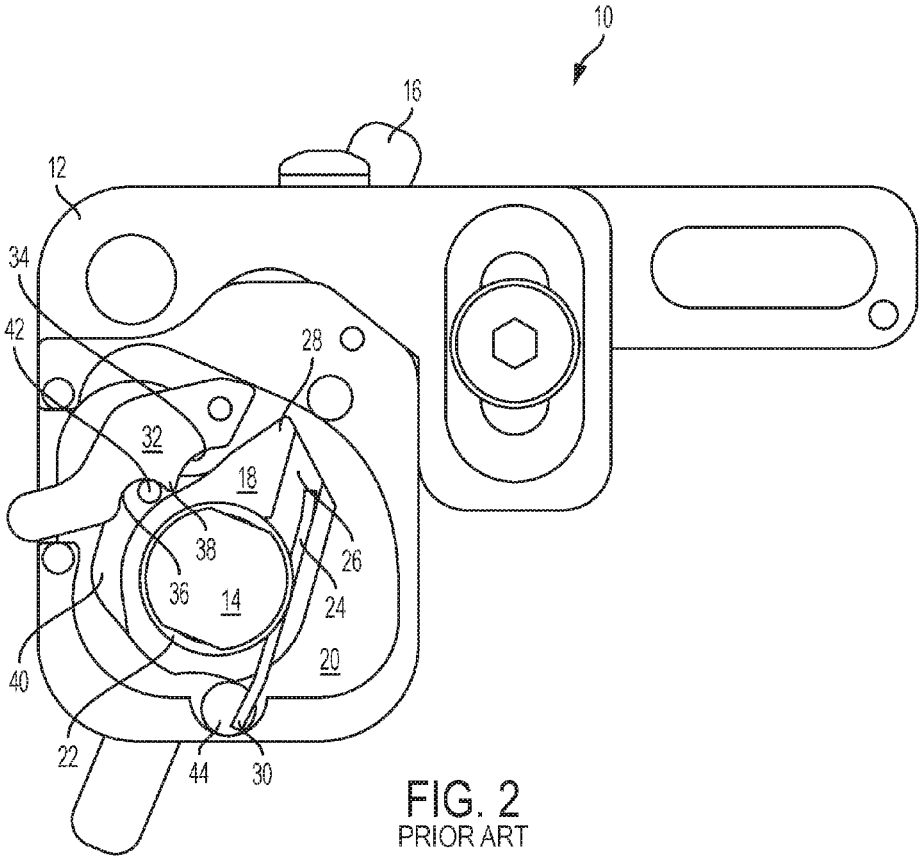
FIG. 2 PRIOR ART
FIG. 2 is an elevation view of the prior art arrow rest of FIG. 1 in the ready position with the cover removed.
Figure 3:
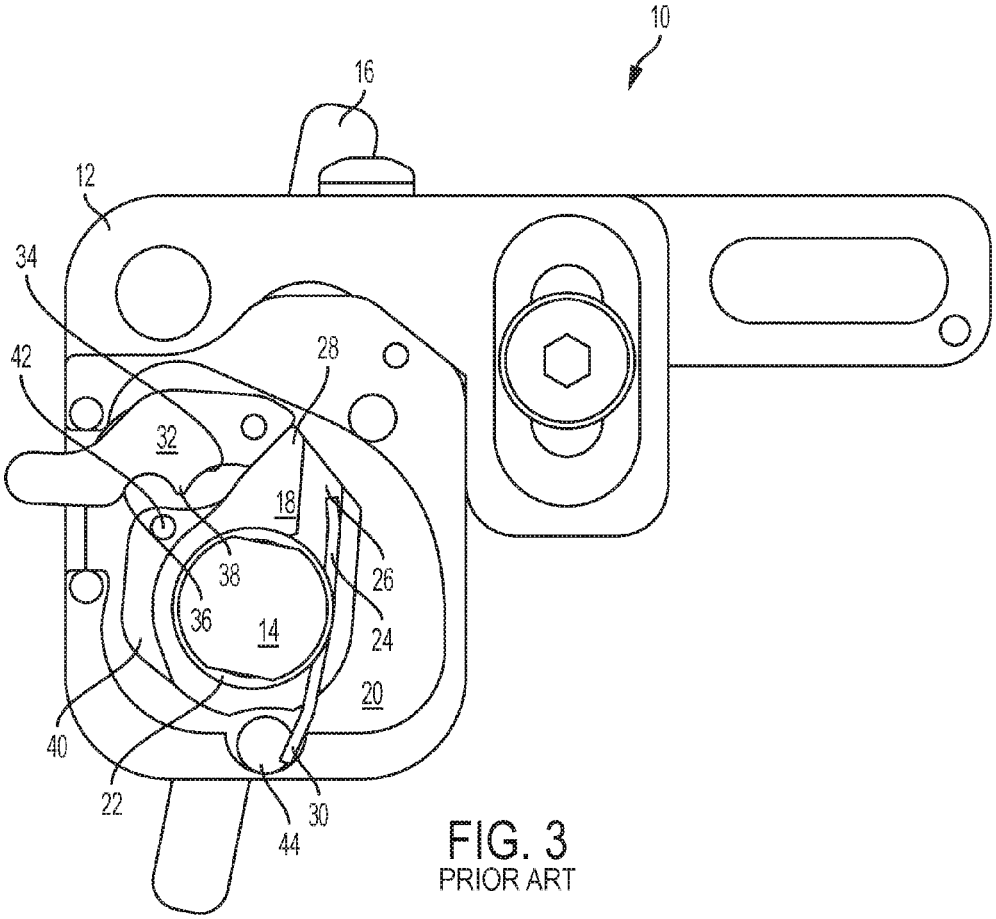
FIG. 3 PRIOR ART
FIG. 3 is an elevation view of the prior art arrow rest of FIG. 1 in the drawn position with the cover removed.
Figure 4:
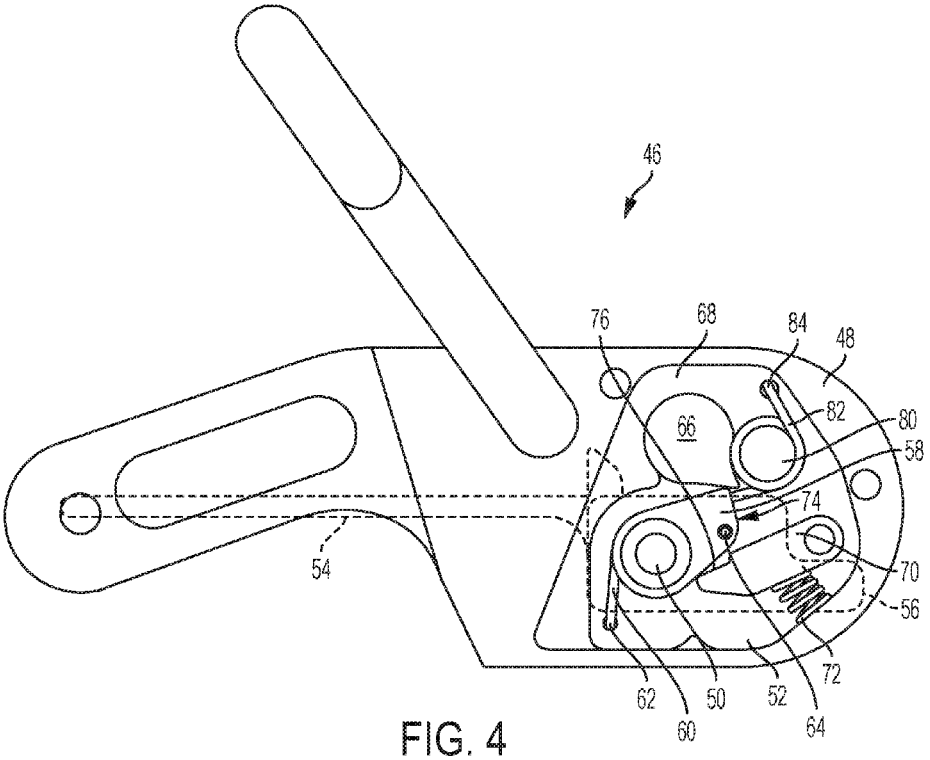
FIG. 4 PRIOR ART
FIG. 4 is an elevation view of another prior art arrow rest in the rest position with the cover and hammer removed.
Figure 5:
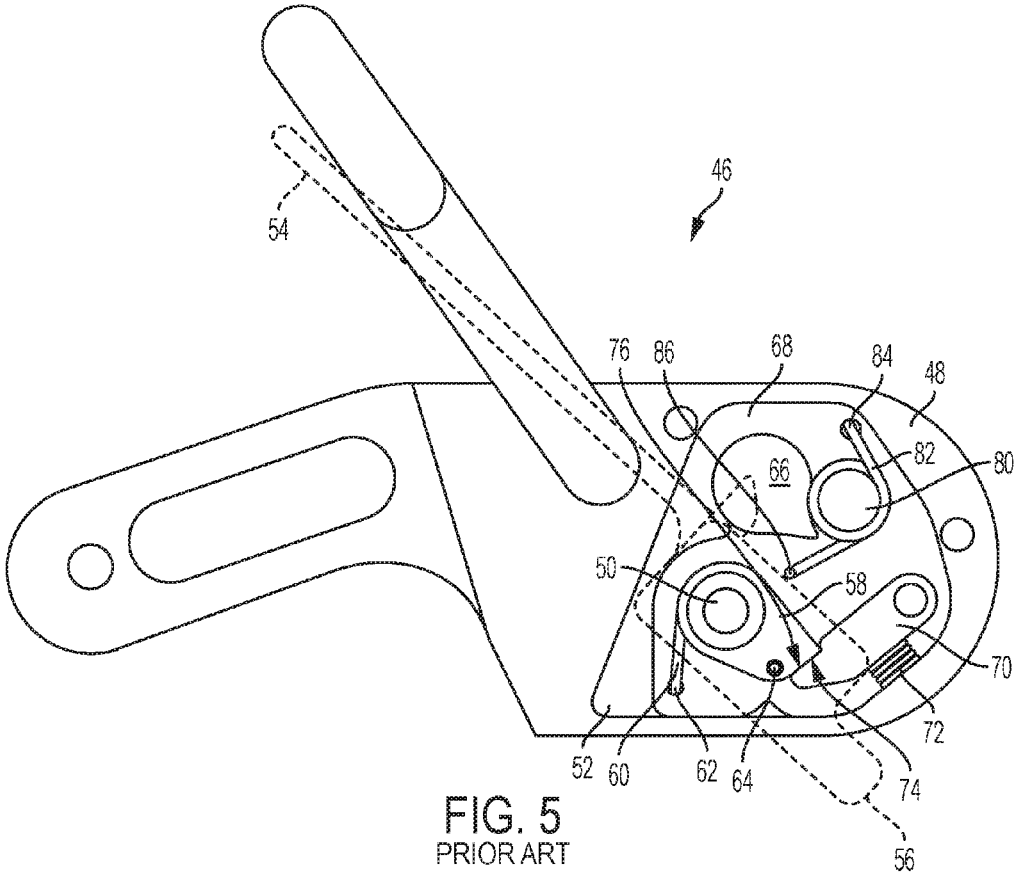
FIG. 5 PRIOR ART
FIG. 5 is an elevation view of the prior art arrow rest of FIG. 4 in the ready position with the cover and hammer removed.
Figure 6:
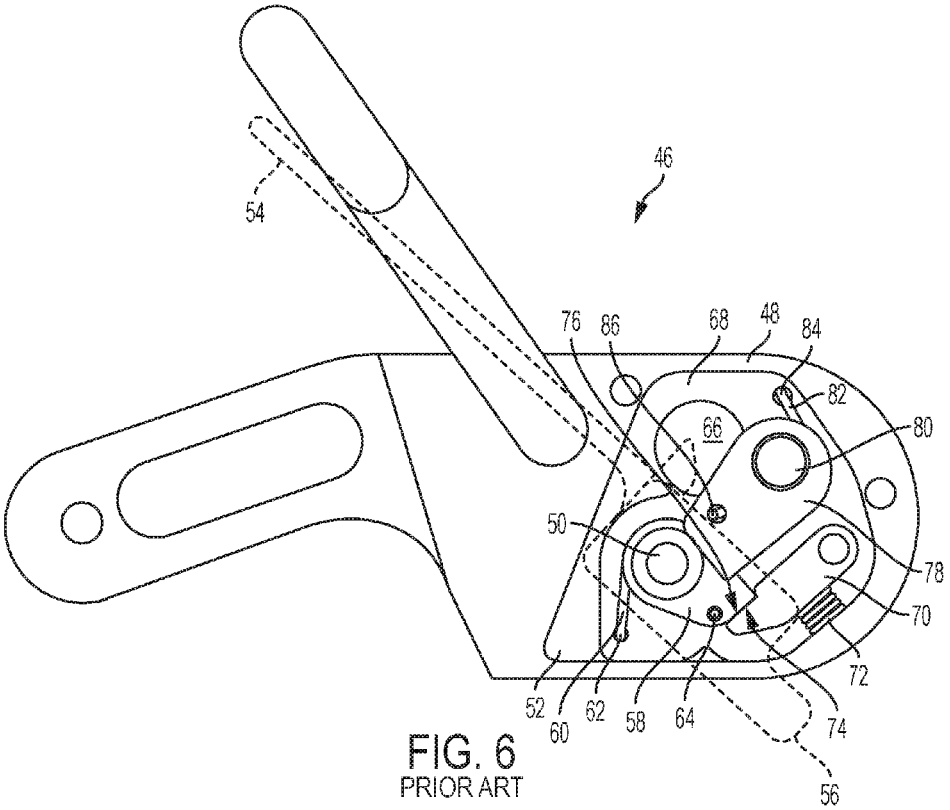
FIG. 6 PRIOR ART
FIG. 6 is an elevation view of the prior art arrow rest of FIG. 4 in the drawn position with the cover removed.
Figure 7:
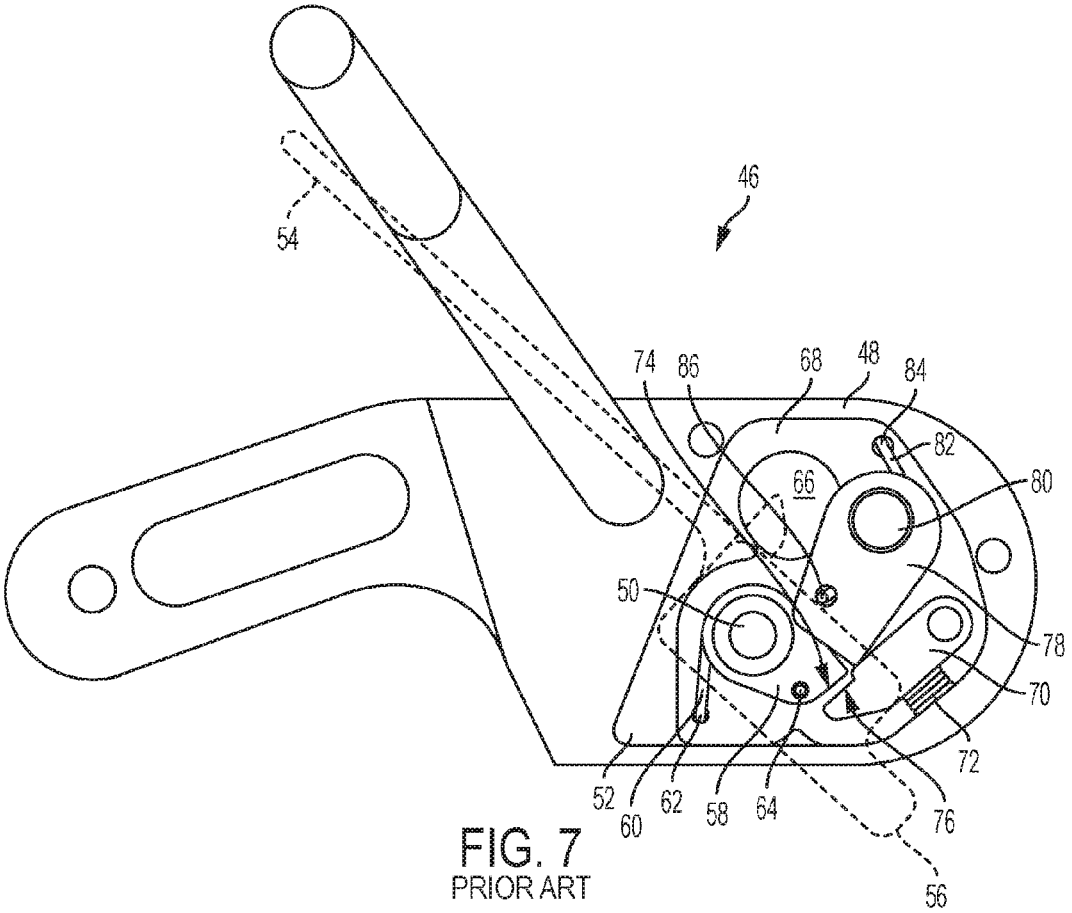
FIG. 7 PRIOR ART
FIG. 7 is an elevation view of the prior art arrow rest of FIG. 4 immediately after the bowstring is released with the cover removed.

The arrow rest 88, as seen in FIGS. 8-11, includes a frame 90 for attaching the arrow rest to a bow (B). For example, the frame 90 may include a slot 92. The slot 92 is sized to receive fastener that extends through the slot and into an opening in the bow (B) to attach the arrow rest 88 to the bow. The slot 92 allows the arrow rest 88 to be adjusted along the length of the slot. Other means are known in the art for attaching an arrow rest to a bow, the use of which would not defeat the spirit of the invention.

The arrow rest 88 also includes means for adjusting the arrow rest vertically 94 and means for adjusting the arrow rest horizontally 96. For example, the means for adjusting the arrow rest vertically 94, as seen in one embodiment shown in FIG. 9, includes a fixed frame member 98, a movable frame member 100 and a fastener 102. The fixed frame member 98 includes a threaded hole (not shown). The fastener 102 extends through a slot 104 in the movable frame member 100 and into the threaded hole. The slot 104 is sized such that the shank of the fastener 100 may extend through, but the head is prevented from passing through the slot.

Figure 10:
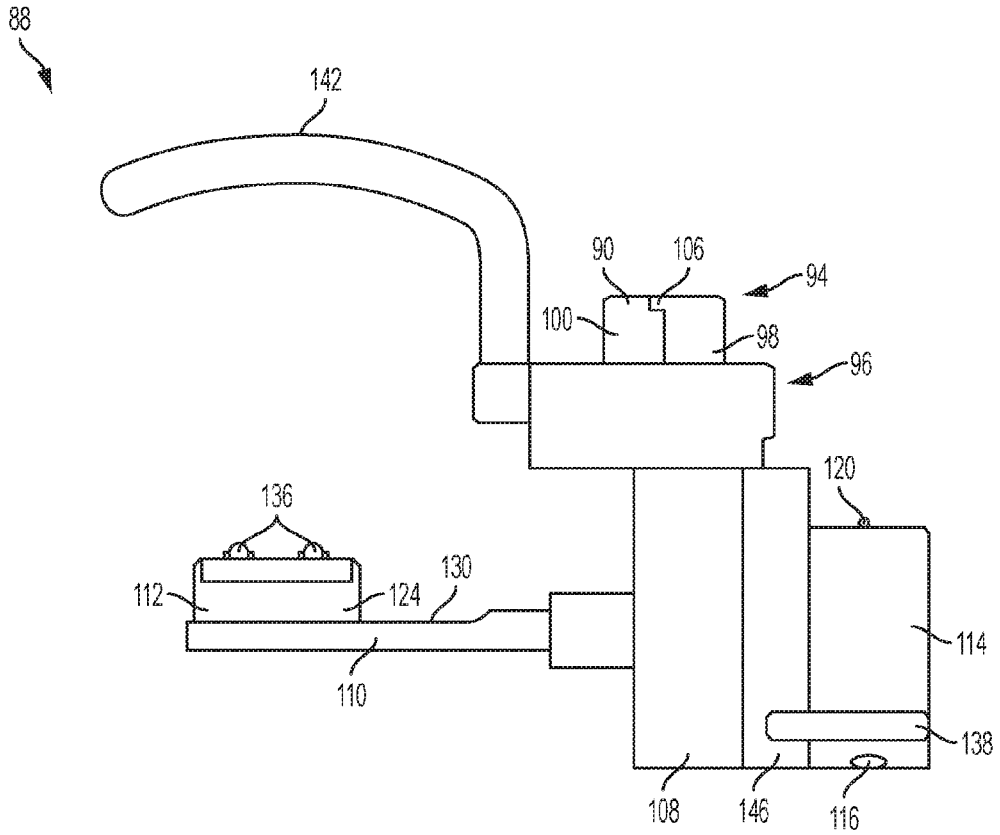
FIG. 10 is a front elevation view of the arrow rest of FIG. 9.

As seen in FIG. 10, the movable frame member 100 includes a tongue 106 that resides in a groove (not shown) in the fixed frame member 98. When the fastener 102 is loosened, the movable frame member 100 may move along the groove in the fixed frame member 98 to allow the arrow rest 88 to be adjusted. When the desired position of the arrow rest is obtained, the fastener 102 can be tightened, clamping the fixed frame member 98 to the movable frame member 100. Although a tongue and groove relationship is shown, other means for adjusting an arrow rest vertically and horizontally are known in the art, e.g. a gear and pinion, the use of which would not defeat the spirit of the invention. A similar structural relationship is provided for the means for adjusting the arrow rest horizontally 96.

Figure 11:
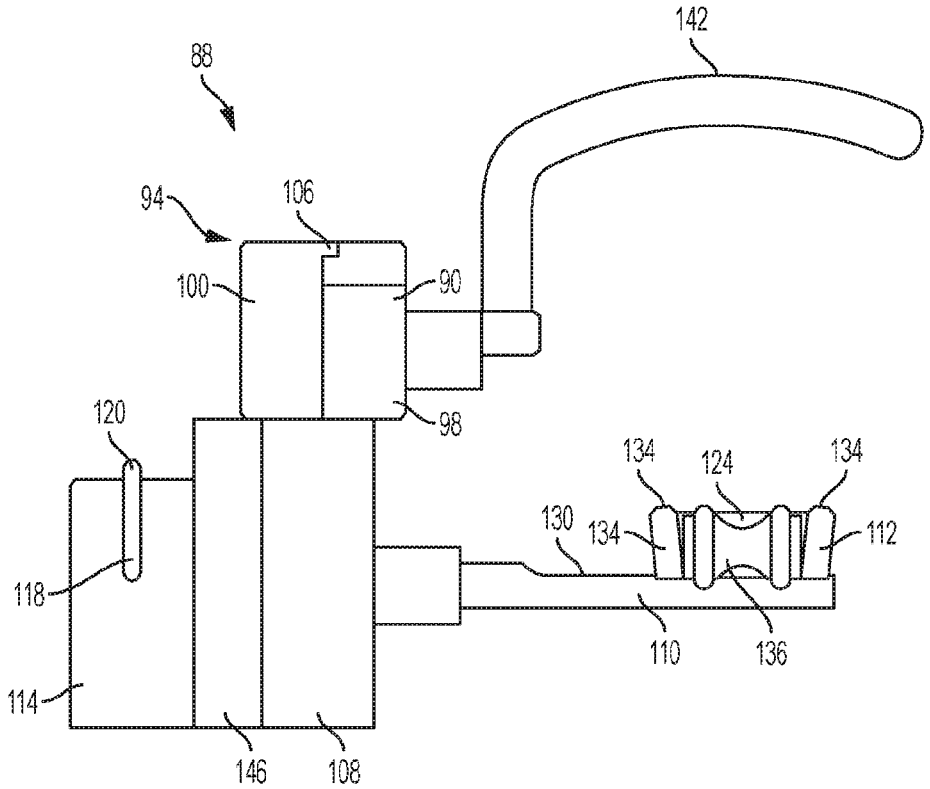
FIG. 11 is a rear elevation view of the arrow rest of FIG. 9.

The frame 90 of arrow rest, as seen in FIGS. 10-11, includes a housing 108 that rotatably supports a shaft 110. An arrow support member 112 is attached to a first end of the shaft 110. A second end of the shaft 110 is attached to a knob 114. In the embodiment seen in FIG. 9, a threaded insert 116 is screwed into a threaded bore in the knob 114 to attach the knob to the shaft 110. The portion of the shaft 110 that receives the knob 114 may have a blind bore (not shown) to receive the threaded insert to more securely attach the knob to the shaft.

Figure 9:
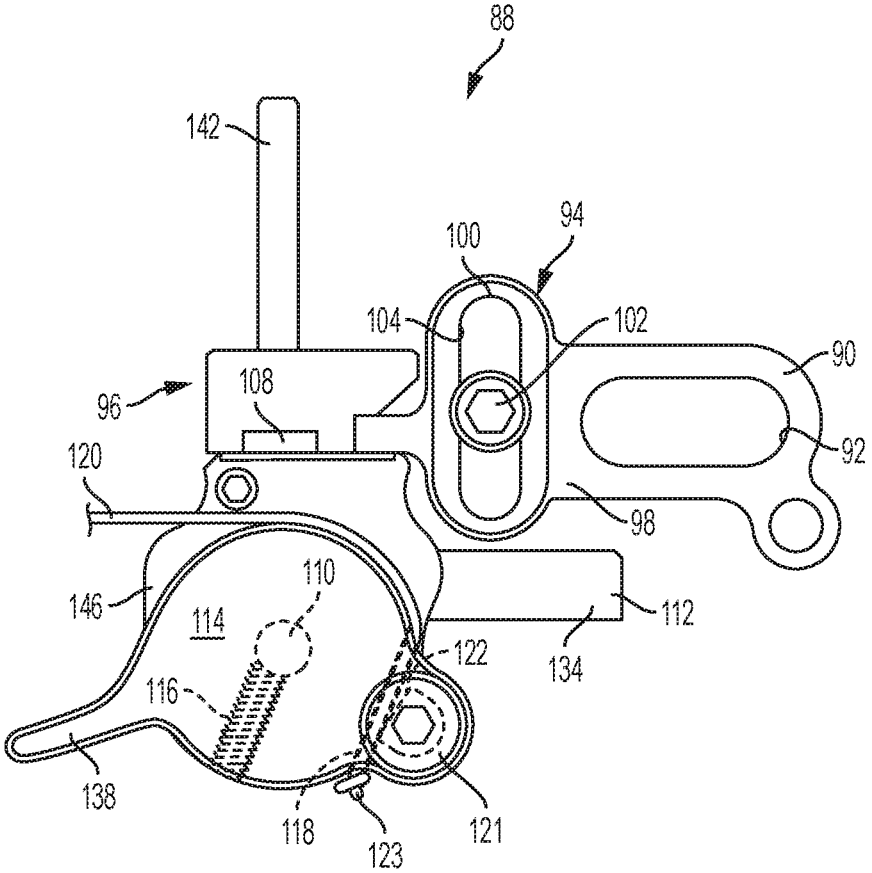
FIG. 9 is a side elevation view of the arrow rest in the down position.

As seen in FIG. 9, the knob 114 has a passage 118 for attaching a cord 120 to the arrow rest. One end of the cord 120 is inserted through the passage 118. The passage 118 goes through an opening for a fastener 121 in the knob 114. The shaft of the fastener 121 includes a flat side 122 such that when the fastener is rotated so that the flat side is aligned with the passage 118, the passage is uninterrupted and the card 120 may pass there-through. Once the cord 120 is in the passage 118, the fastener 121 can be rotated so that the flat end 122 is not aligned with the passage to pinch and hold the cord to the knob 114.

Figure 19:
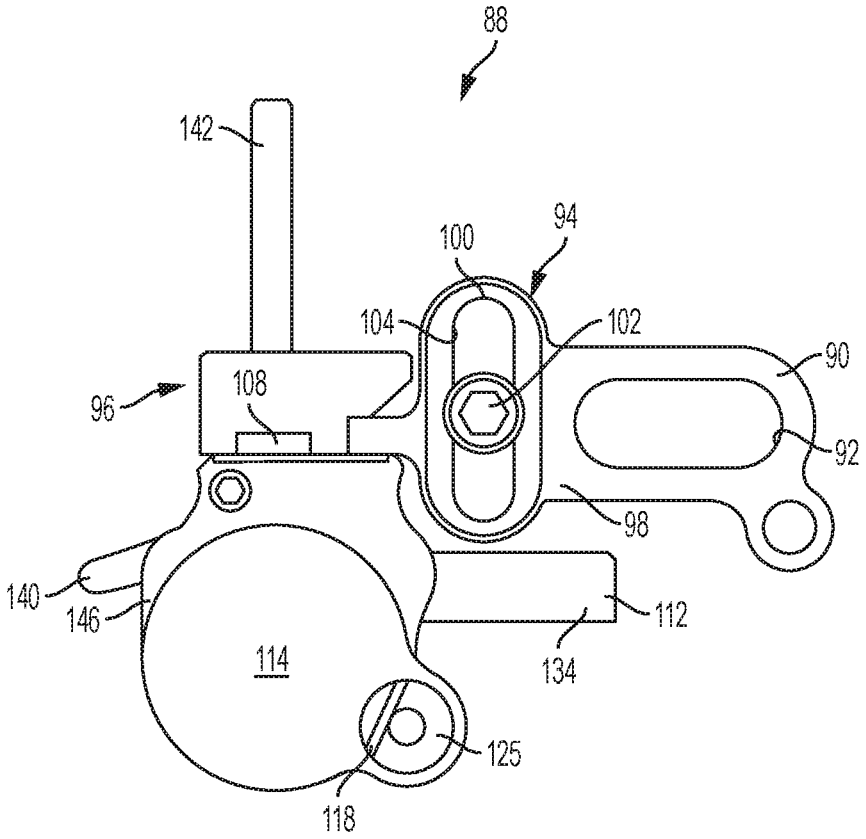
FIG. 19 is a side elevation view of the arrow rest of FIG. 17 in the partially up position with a fastener removed from the knob.

Although in one embodiment, the cord 120 is attached to the arrow rest 88 by the shaft of the fastener 121, other means for attaching a cord to an arrow rest are known in the industry, the use of which would not defeat the spirit of the invention. For example, as seen in FIG. 19, the knob 114 includes an opening 125 for the fastener 121 such that the fastener is countersunk in the knob when tightened. The passage 118 passes through the opening 125 such that part of the cord 120 is exposed in the opening.

Figure 8:
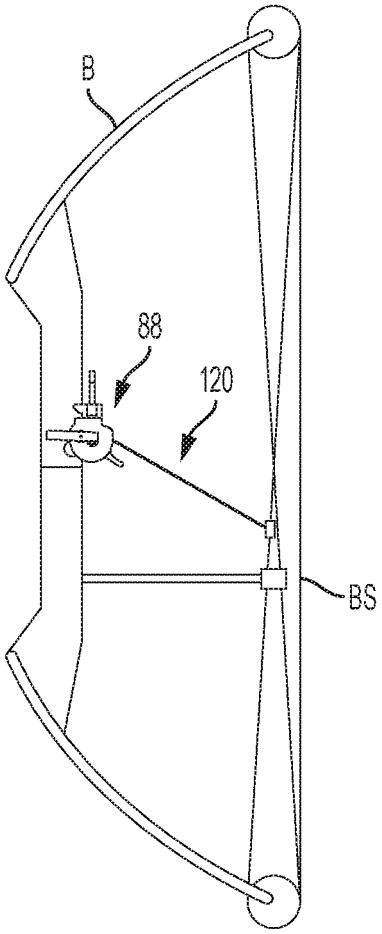
FIG. 8 is a side elevation view of the arrow rest in accordance with the present invention attached to a bow.

When a fastener 121, or fastener with a washer, is placed in the opening 125 and tightened, the head of the fastener, or washer, will secured the cord 120 to the knob 114. By way of another example, the cord 120 can be held to the knob 114 by an enlarged end 123 which can be added to the cord to prevent the cord from being pulled through the passage as seen in FIG. 9. There are many ways of adding an enlarged end to a cord, e.g. a knot, nut, washer, cable ends, etc., the use of which would not defeat the spirit of the invention. The other or second end of the cord 120 is attached to the bowstring (BS) of a bow (B), as seen in FIG. 8, such that when the bowstring is drawn, the cord will be pulled away from the arrow rest thereby rotating the knob 114.

In embodiment seen in FIGS. 9-12, the arrow support member 112 has a base 124 with a groove 126 with two holes 128 in the groove. The portion of the shaft 110 attached to the arrow support member 112 has a flat side 130 with a plurality of holes 132. The flat side 130 of the shaft 110 is set in the groove 126 of the arrow support member 112. The two holes 128 of the arrow support member 112 are matched up with two of the plurality of holes 132 in the shaft 110 and a fastener is inserted into the holes 128, 132 to attach the shaft 110 to the arrow support member 112. The plurality of holes 132 in the shaft 110 allow further adjustment of the arrow rest 88. There are other means for allowing adjustment to the arrow support member know in the art, e.g. providing a bore in the knob 114 such that the shaft 110 can be adjusted through the bore, the use of which would not defeat the spirit of the invention.

Extending from the base 124 of the arrow support member 112 is a pair of upright arms or extensions 134. In the embodiment seen in FIGS. 9-12, the arms 134 are spaced closer together at the base 134 than at their opposite ends. This spacing makes it easier to load an arrow shaft between the arms 134 at the top while at the same time providing less play between the arrow shaft and the arms when the arrow shaft is seated lower in the arrow support member 112.

As seen in FIGS. 9-12, the arrow support member also has a roller 136 extending between and rotatably connected to the arms 134. The roller 136 helps reduce friction when the arrow is released because the roller 136 will rotate during the short period of time the arrow support member 112 is in contact with the arrow shaft before the arrow support member rotates out of contact as will be discussed further below.

Figure 22:
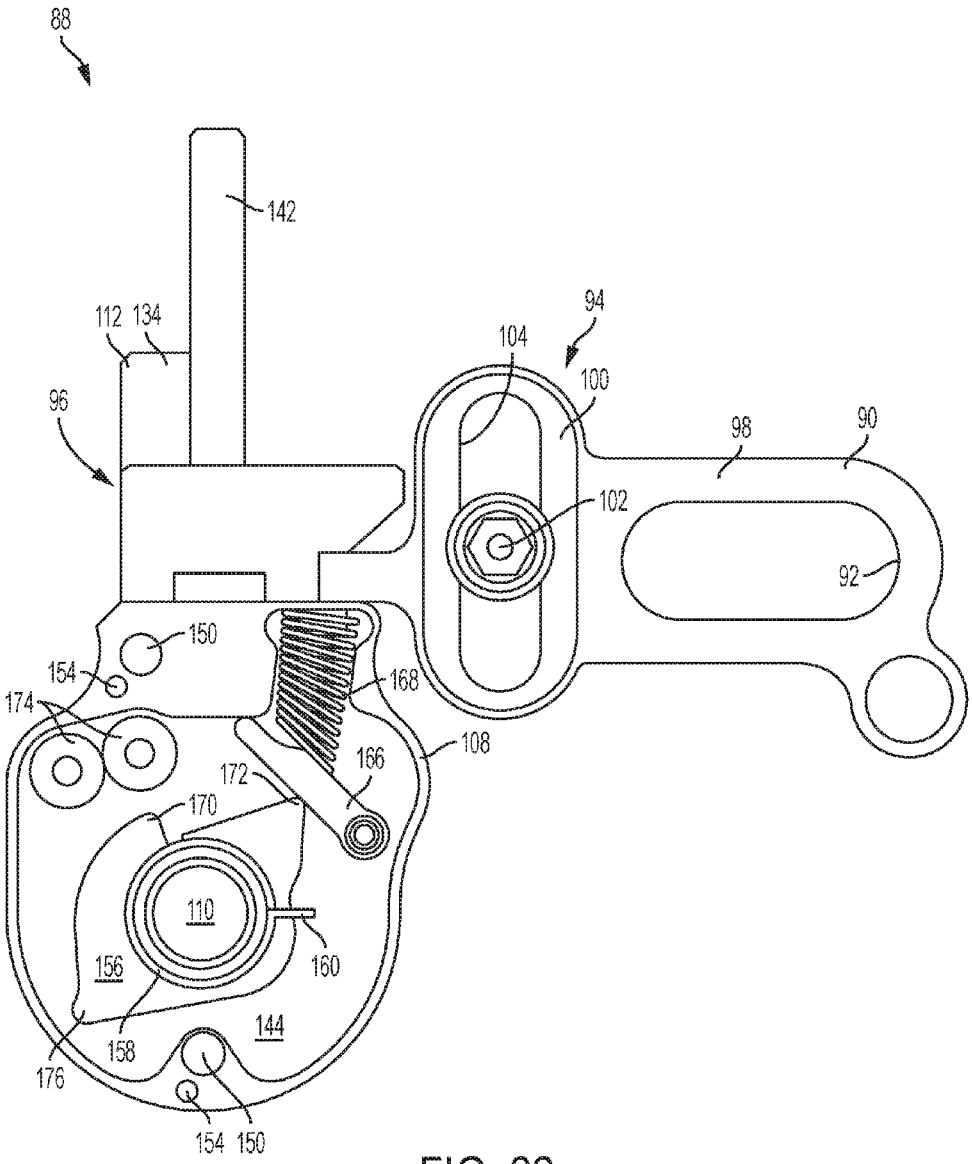
FIG. 22 is a side elevation view of the arrow rest of FIG. 20 with the knob and cover removed and in the up position.

The arrow support member 112 is generally movable to and between three positions, namely, a down position, as seen in FIGS. 9-12, a partially up position, as seen in FIGS. 13-16, and an up position as seen in FIG. 22, although any number of positions could be used, e.g. just a down and up position, without defeating the spirit of the invention.

The arrow support member 112 can be rotated from the down position to the partially up position in a number of ways. One way to move the arrow support member 112 is by drawing the bowstring, e.g. to shoot an arrow. This will pull the cord 120 which in turn will rotate the knob 114. The knob 114 will rotate the shaft 110, which will rotate the arrow support member 112. Another way to move the arrow support member 112 is by manually rotating the arrow support member 112 or the knob 114. In one embodiment seen in FIGS. 9-12, the knob includes a thumb lever 138.

Figure 17:
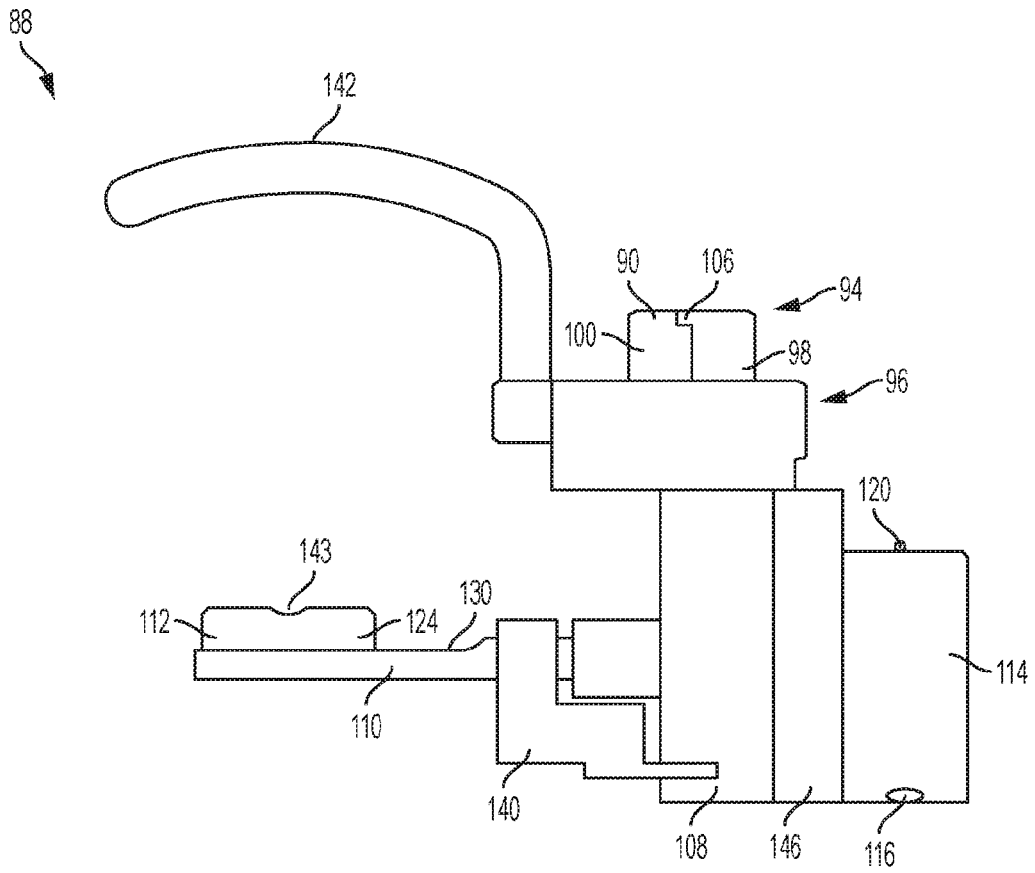
FIG. 17 is a front elevation view of an alternative embodiment of an arrow rest in the down position.
Figure 18:
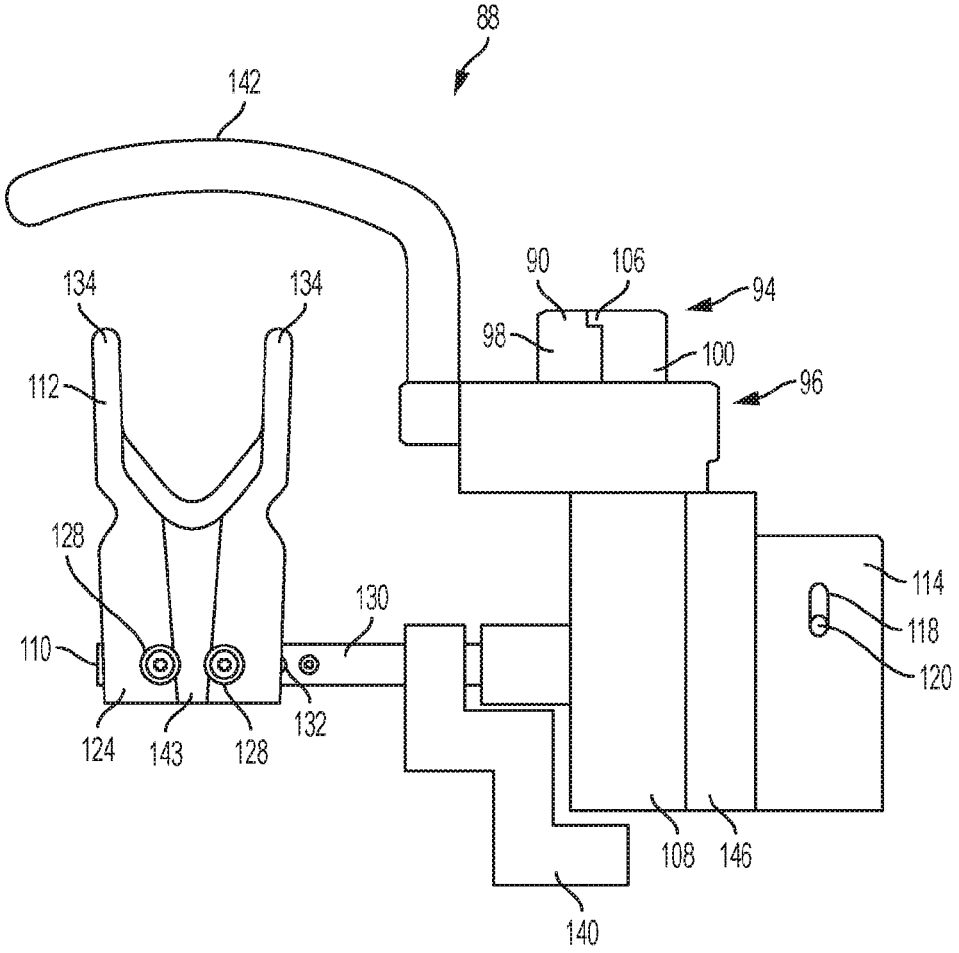
FIG. 18 is a front elevation view of the arrow rest of FIG. 17 in the partially up position.

In another embodiment seen in FIGS. 17-19, the shaft 110 includes a thumb lever 140. The thumb lever 140 could be directly attached to the shaft 110 or could be attached, or integrally formed with, the base 124 of the arrow support member 112. Having a way to rotate the arrow support member 112 with the thumb of the hand the user is using to hold the bow can be advantageous. Therefore, placing a thumb lever, for example, within reach of a user's thumb is a desired feature.

Figure 12:
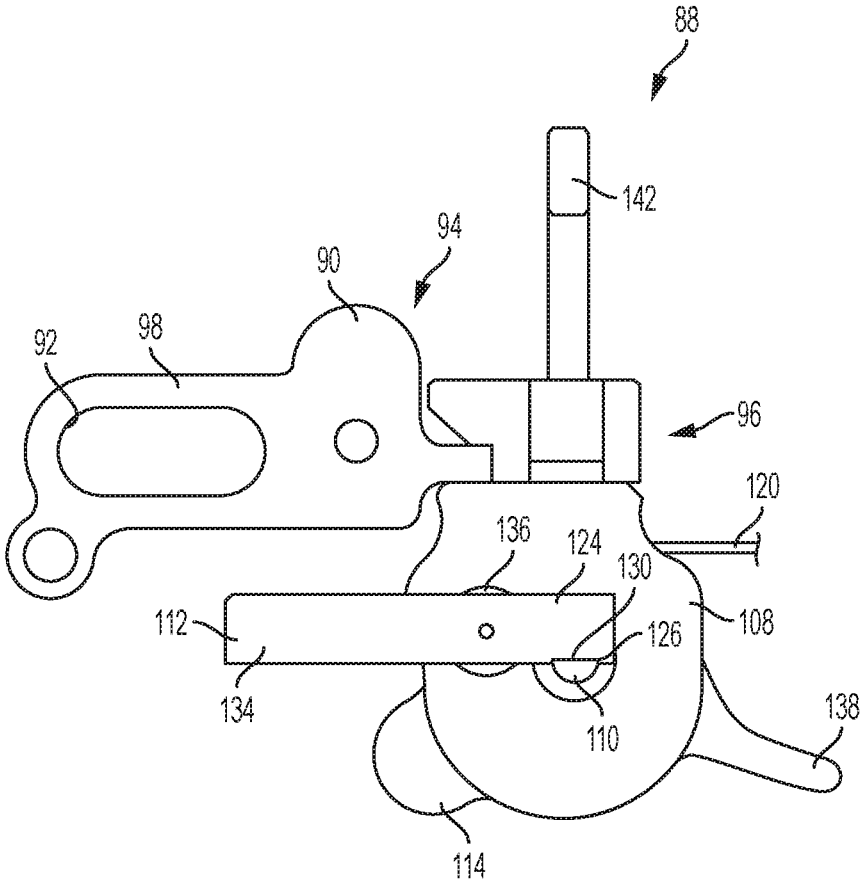
FIG. 12 is another side elevation view of the arrow rest of FIG. 9.
Figure 13:
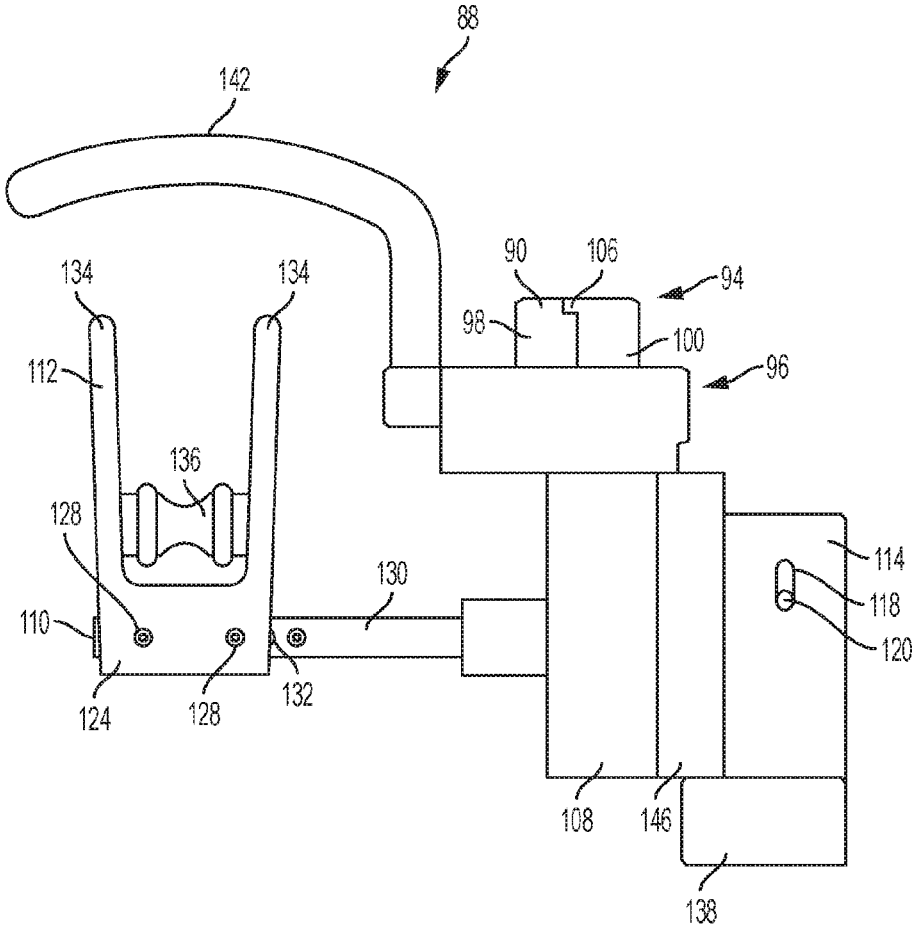
FIG. 13 is a front elevation view of the arrow rest of FIG. 9 in the partially up position.
Figure 14:
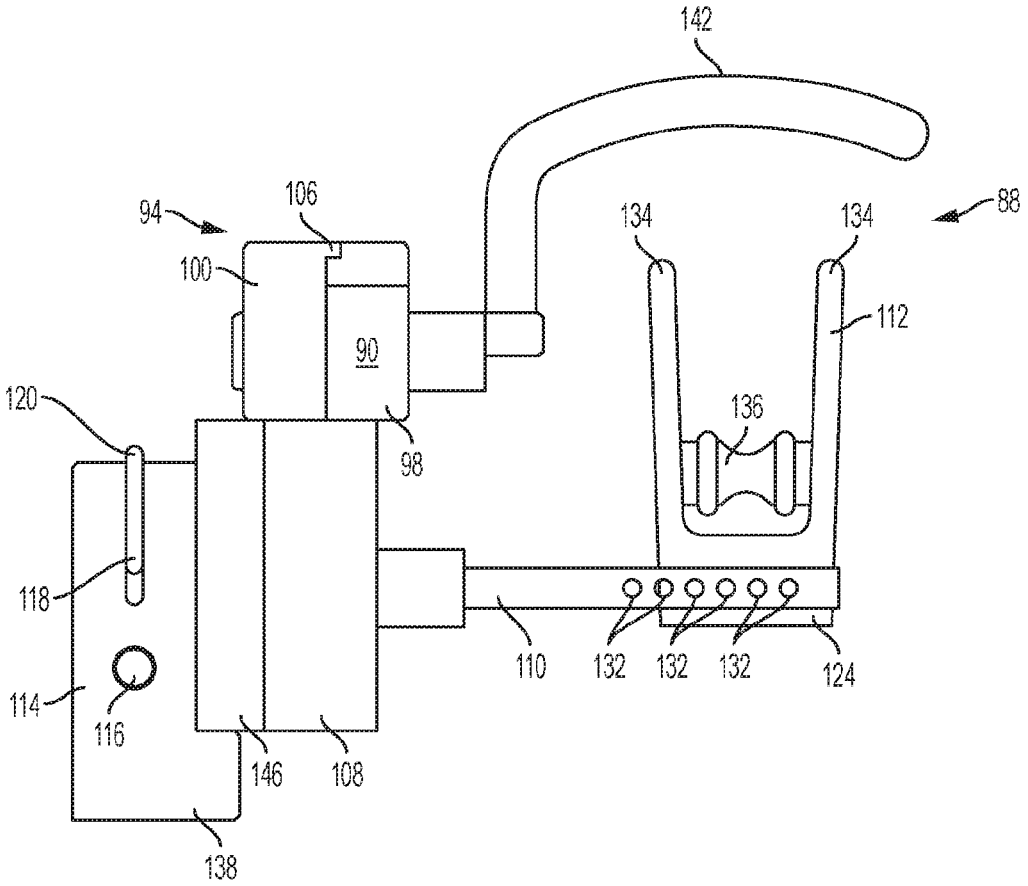
FIG. 14 is a rear elevation view of the arrow rest of FIG. 12.
Figure 15:
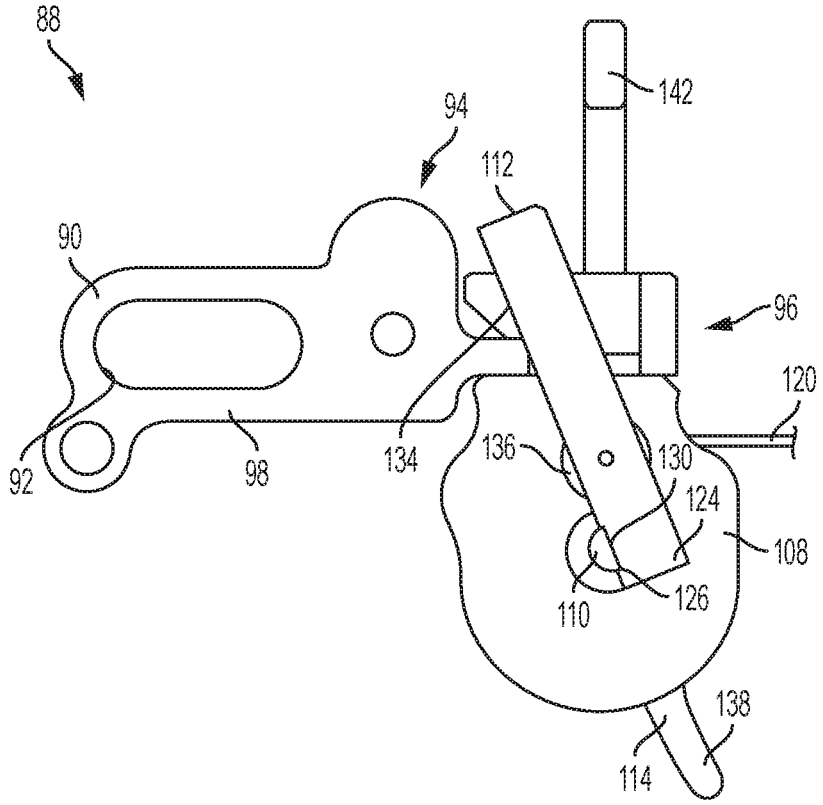
FIG. 15 is a side elevation view of the arrow rest of FIG. 12.

As seen in the embodiment shown in FIGS. 10-12, the diameter of the roller 136 is slightly larger than the thickness of the arms 134. The larger diameter of the roller 136 helps hold an arrow shaft within the arrow support member 112 when in the down position and while being moved to the partially up position.

In another embodiment seen in FIGS. 17-18, the arrow support member 112 includes a groove 143 in the base 124 of the arrow support member. The groove 143 helps hold an arrow shaft within the arrow support member 112 when in the down position and while being moved to the partially up position.

When in the partially up position, a bar 142 extends generally over the open end of the arrow support member 112 to prevent the arrow shaft from falling out of the arrow support member, e.g. if a branch hits the loaded arrow while changing positions during hunting.

Figure 20:
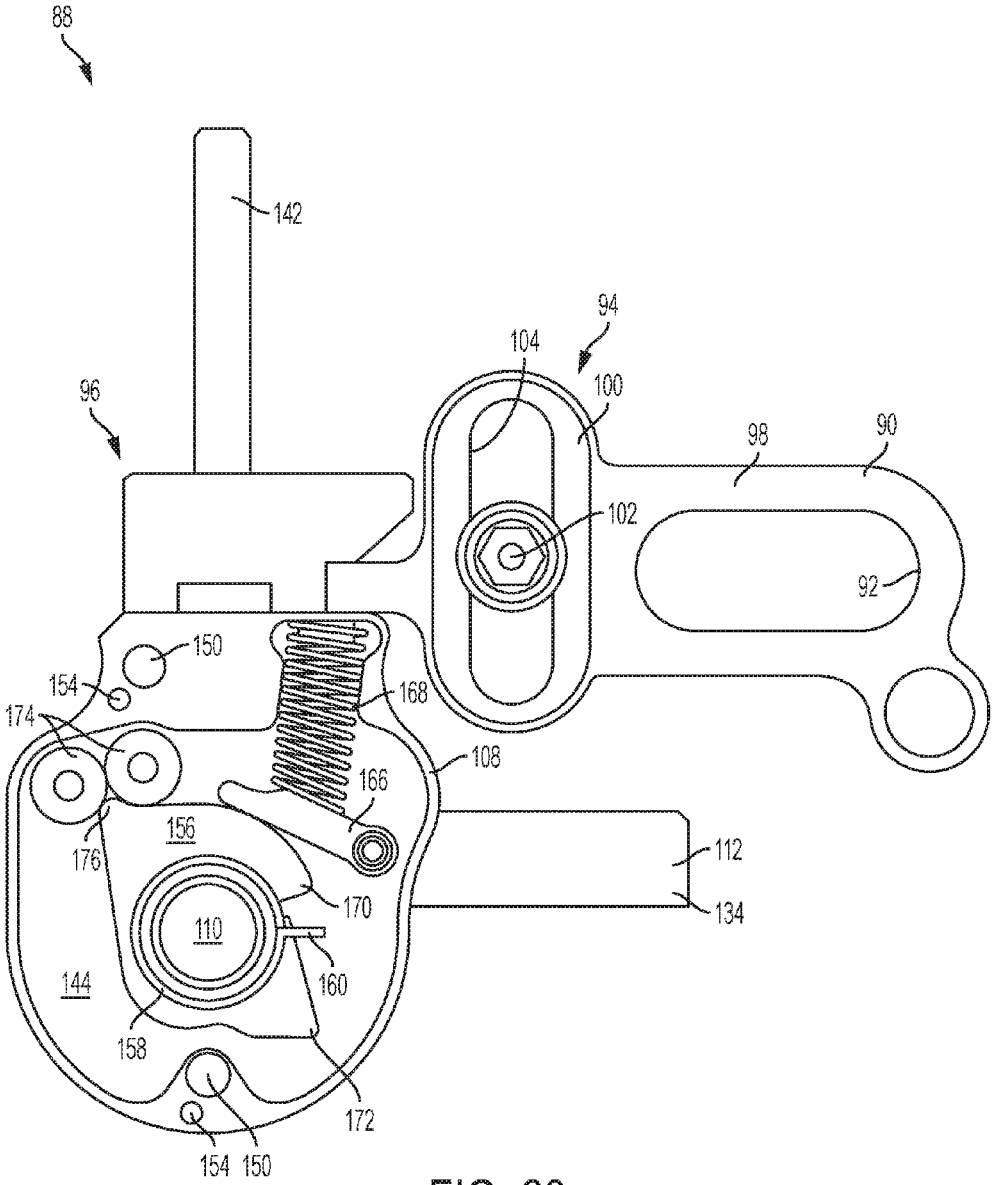
FIG. 20 is a side elevation view of the arrow rest of FIG. 9 with the knob and cover removed and in the down position.
Figure 21:
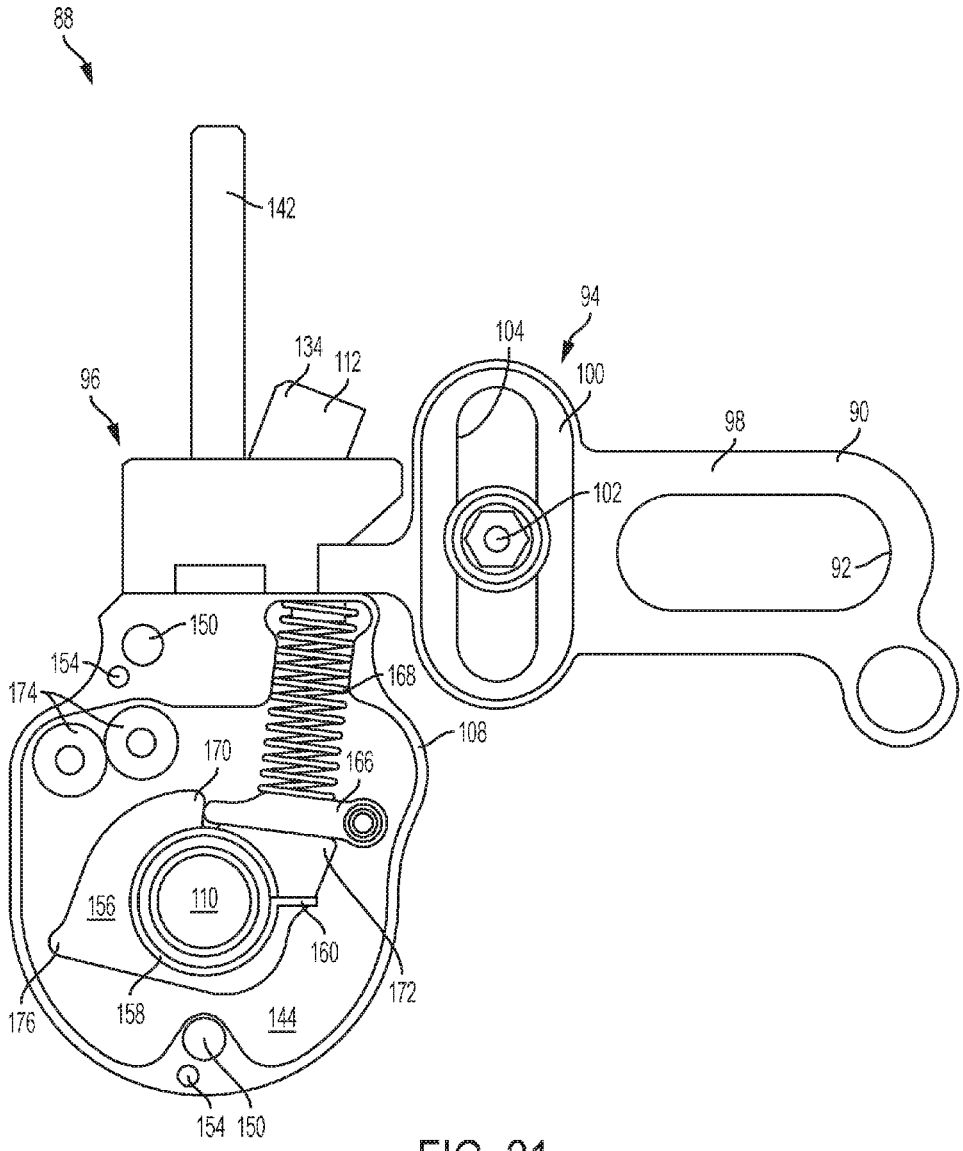
FIG. 21 is a side elevation view of the arrow rest of FIG. 20 with the knob and cover removed and in the partially up position.
Figure 23:
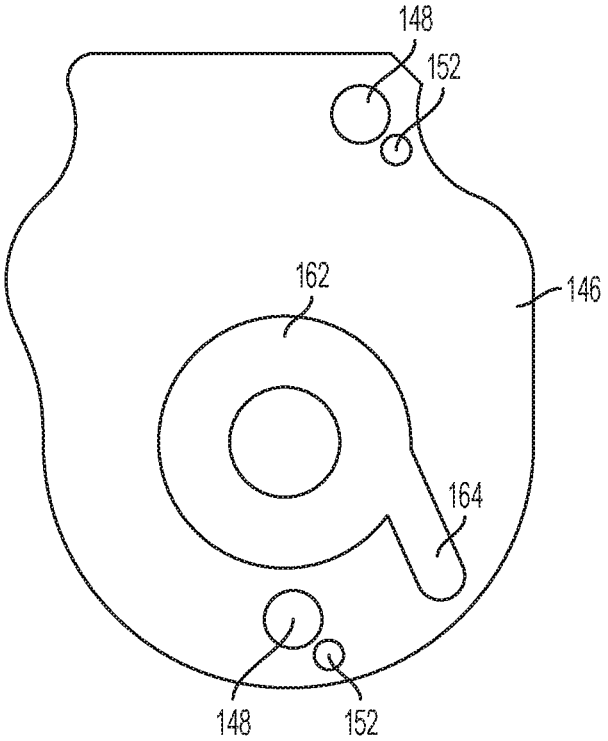
FIG. 23 is an elevation view of the inside of a cover.

The housing 108 includes a chamber 144 as seen in FIGS. 20-22. A removable cover 146 encloses or covers the chamber 144 and provides selective access to the chamber when desired. For example, the cover 146 as seen in FIG. 23 has bores 148 sized to allow fasteners can be inserted at least partially through the bores and into threaded holes 150 in the housing 108 to attach the cover over the chamber 144 and to the housing 108. The cover may also have blind bores 152 that are sized and shaped to receive pins 154 on the housing 108 to help properly orient the cover 146 when attaching it to the housing. The pins 154 also help prevent any play in the cover 146 due to tolerances in, for example, the threaded holes 150 and bores 148 for the fasteners and to prevent wear of the same. Other means are known in the art to attach a cover to a housing, e.g. threading the cover on the housing, the use of which would not defeat the spirit of the invention.

A portion of the shaft 110 extends through in the chamber 144. A cam or rotor 156 is attached to the portion of the shaft 110 in the chamber 144 by, for example, a pin (not shown) that extends through the cam and into a blind bore (not shown) in the shaft. Other means are known for attaching a cam to a shaft, e.g. gluing, integrally forming, etc., the use of which would not defeat the spirit of the invention.

A biasing member 158 is located on the shaft 110. The biasing member 158 is shown in FIGS. 20-22 as a torsion spring, but could include other types of springs, e.g. mechanical or pneumatic, shocks, dampers or elastic or compressible members known in the industry, the use of which would not defeat the spirit of the invention. A first or cam end (not shown) of the biasing member 158 is attached to the cam 156. For example, the cam end of the biasing member 158 can be held or retained in a bore (not shown) of the cam 156. A second or stationary end 160 of the biasing member 158 is attached to the arrow rest 88 such that the stationary end does not move with respect to rotation of the cam 156.

In one embodiment seen in FIG. 23, the cover 146 includes a recess 162 to accommodate the biasing member 158 when the cover is attached to the housing 108. The cover 146 can also include a slot 164 to hold the stationary end 160 of the biasing member 158. In the embodiment seen in FIG. 23, the cover is rotated such that the slot 164 is lined up with the stationary end 160 of the un-torqued biasing member 158 (as seen in FIG. 20). In this position the cover will not be correctly lined up with the housing 108. Then, with the stationary end 160 of the biasing member 158 in the slot 164 of the cover 146, the cover is rotated to the correct orientation such that the pins 154 are received in the blind bores 152. Screws are inserted in bores 148 of the cover 146 and bores 150 in the housing 158 to secure the cover to the housing. When secured, the biasing member 158 will be torqued and urging the shaft 110 clockwise (as seen in FIGS. 20-22) and, thereby, the arrow support member 112 towards the down position.

A bar or finger 166 is pivotally attached to a wall of the chamber 144. One end of the finger 166 is urged into contact with the cam 156 by a compressible member 168 located between the wall of the chamber and the finger 166. The compressible member 168 is shown in FIGS. 20-22 as a compression spring, but could include other types of springs, e.g. mechanical or pneumatic, shocks, dampers or elastic or compressible members known in the industry, the use of which would not defeat the spirit of the invention.

The exterior profile of the cam 156 includes a notch or indent 170. As the shaft 110 is rotated counterclockwise, and the cam 156 thereby, against the urging of the biasing member 158, towards the partially up position, the finger 166 rides against the exterior of the cam 156 as seen in FIG. 20. When the cam 156 is rotated such that the finger 166 reaches the notch 170, the compressible member 168 will push the finger into the notch as seen in FIG. 21 such that the finger engages the notch. Because the biasing member 158 is urging the cam 156 clockwise, the finger 166 will selectively hold the cam and the arrow support member 112 in place. In this shaft 110 and cam 156 orientation, the arrow support member 112 is in the partially up position.

Figure 16:
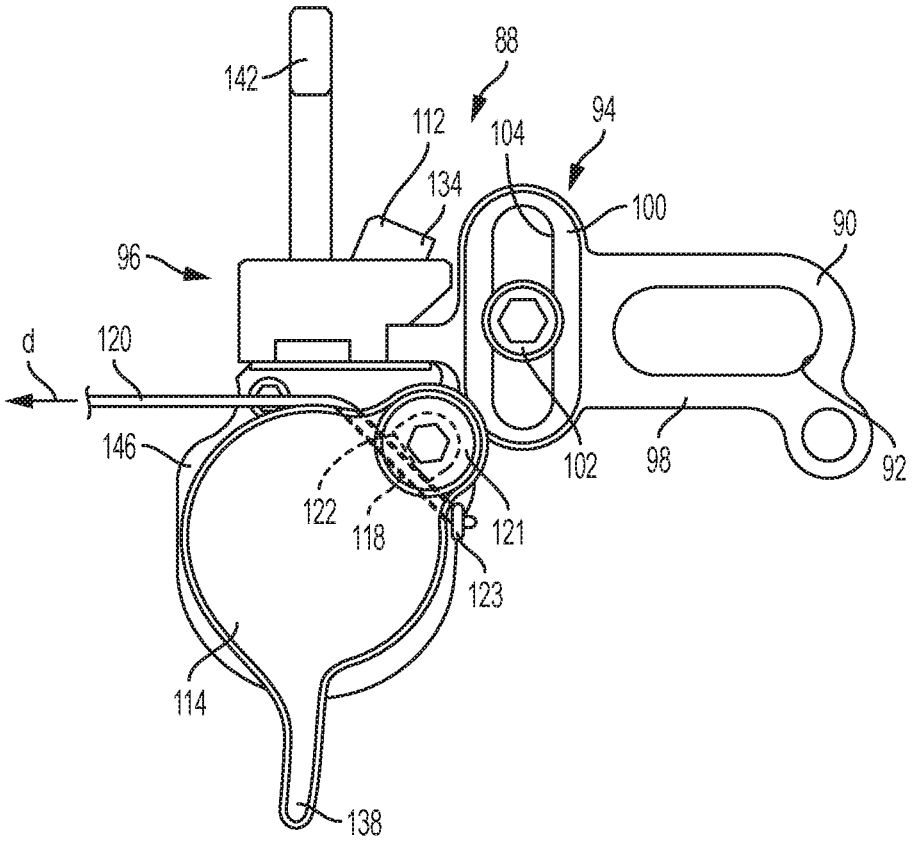
FIG. 16 is another side elevation view of the arrow rest of FIG. 12.

When the bowstring is drawn, the cord 120 will be pulled in direction "d" as seen in FIG. 16. The cord 120 will in turn cause the knob or lever 114 to rotate counterclockwise. The rotating of the knob 114 will cause rotation of the shaft 110. Rotation of the shaft 110 will cause rotation of the cam 156 and arrow support member 112 in a counterclockwise direction as seen by comparing FIGS. 20-22. Rotation of the cam 156 will cause a projection 172 of the cam 156 to contact the finger 166, pushing the finger out of the notch 170 against the urging of the compressible member 168, as seen in FIG. 22, thereby disengaging the finger from the notch. The knob 114, shaft 110, cam 156 and arrow support member 112 will be prevented from turning any further, when the projection 172 pushes the finger 166 into contact with a wall of the chamber 144. In this shaft 110 and cam 156 orientation, the arrow support member 112 is in the up position.

When the bowstring is released, the tension on the cord 120 will be released, which will in turn allow the biasing member 158 to rotate the cam 156 clockwise towards the down position. In the embodiment seen in FIGS. 20-22, the biasing member 158 is strong enough to rotate the cam 156 clockwise such that the notch 170 passes the finger 166 before the compressible member 168 urges the finger back into contact with the cam thereby returning the arrow support member 112 to the down position. This provides a clear path for the arrow and fletching.

If, however, the bowstring is drawn and the arrow support member 16 is rotated to the up position, but the bowstring is not released and is instead returned in a controlled manner to the undrawn position, the arrow support member will return to the partially up position. The controlled return of the bowstring from the drawn to the undrawn position will counteract the urging of the biasing member 158 and allow the compressible member 168 to push the finger 166 into the notch 170 of the cam 156.

The arrow rest 88 also includes a deceleration mechanism. In the embodiment shown in FIGS. 20-22, the decelerations mechanism includes a pair of bumpers or rubber bushings 174 attached to a wall of the chamber 144. As the biasing member 158 is rotating the cam 156, which is shown in one embodiment as having an oblong profile, towards the down position, an extension 176 of the cam will contact the first bumper 174. The force of the biasing member 158 and momentum caused by the rotation of the cam 156 will cause the extension 176 to compress and slide past the first bumper, while decelerating or slowing the rotation of the cam. The cam 156 will continue rotation until the extension 176 contacts the second bumper 174 wherein the first and second bumpers will then cooperate to selectively hold the extension there-between and the cam 156, shaft 110 and arrow support member 112 in the down position as seen in FIG. 20. In the embodiment shown in FIGS. 20-22, the bumpers 174 are made from rubber, e.g. rubber washers, rubber sleeves, etc., and also help prevent the cam from making a loud noise when being rapidly returned from the up position to the down position.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. An arrow rest comprising:
a housing with a chamber;
a shaft rotatably supported by the housing and extending through the chamber;
an arrow support member connected to one end of the shaft;
a knob connected to a second end of the shaft;
a cord with one end attached to the knob and a second end capable of being attached to a bowstring;
a cam attached to the shaft inside the chamber, the cam having a notch; and
a finger pivotally attached to a wall of the chamber with one end biased towards the shaft and urged into contact with the cam by a compressible member;
wherein the arrow support member is selectively held in a partially up position when the one end of the finger engages the notch of the cam;
wherein the cord causes rotation of the arrow support member to a up position and the finger is disengaged from the notch when the cord is attached to a bowstring and the bowstring is drawn; and
wherein when the arrow support member is in the up position and the bowstring is released, a biasing member rotates the cam to a down position before the compressible member can urge the finger into engagement with the notch.

2. The arrow rest of claim 1 wherein the cam has an oblong profile and the finger is disengaged from the notch by one end of the cam.

3. The arrow rest of claim 2 further comprising a deceleration mechanism, wherein when the biasing member is rotating the cam to the down position, the deceleration mechanism decelerates the rotation of the cam.

4. The arrow rest of claim 3 wherein the deceleration mechanism includes a pair of bumpers attached to the wall of the chamber and wherein the arrow support member is selectively held in the down position when an end of the cam is between the pair of bumpers.

5. The arrow rest of claim 1 wherein the arrow support member includes a pair of upright arms and a roller extending between the pair of upright arms.

6. The arrow rest of claim 1 wherein the arrow support member includes a base with a grooved formed in the base sized and shaped to at least partially receive an arrow shaft.

7. The arrow rest of claim 1 further comprising:
a means for adjusting the arrow rest vertically; and
a means for adjusting the arrow rest horizontally.

8. The arrow rest of claim 7 wherein the shaft includes a plurality of holes and the arrow support member includes at least two holes and wherein the arrow support member is adjustably connected to the shaft when the at least two holes are aligned with two of the plurality of holes and a fastener extends at least partially through the at least two holes and the two of the plurality of holes.

9. The arrow rest of claim 1 further comprising a removable cover for covering the chamber.

10. The arrow rest of claim 9 wherein the cover includes a slot for retaining one end of the biasing member and the cam retains a second end of the biasing member.

11. The arrow rest of claim 1 wherein the knob includes a passage and the one end of the cord extends through the passage is attached to the knob by a fastener.

12. The arrow rest of claim 1 wherein the knob includes a passage and the one end of the cord extends through the passage is attached to the knob by an enlarged end.

13. A bow having a bowstring, an arrow rest attached to the bow and a cord connected to the arrow rest and the bowstring, the arrow rest comprising:
a frame;
a shaft rotatably connected to the frame;
an arrow support member connected to a first end of the shaft;
a lever attached to a second end of the shaft, the cord being attached to the lever of the arrow rest;
a rotor attached to the shaft between the arrow support member and the lever and having an indent in an exterior surface of the rotor;
a bar urged into contact with the exterior surface of the rotor;
wherein the arrow support member is selectively held in a first position when the bar is located in the indent;
wherein when the bowstring is drawn, the cord causes the arrow support member to rotate in a first direction and the bar is in contact with the exterior surface of the rotor;
wherein when the bowstring is released, the arrow support member is rotated in a second direction;
wherein when the arrow support member is rotated in a second direction and to a second position, a portion of the rotor is selectively held by a deceleration mechanism.

14. The bow of claim 13, wherein the deceleration mechanism is a pair of rubber bushings and the rotor is selectively held by the deceleration mechanism when an extension of the rotor is located between the pair of rubber bushings.

15. The bow of claim 13, further comprising a thumb lever attached to the shaft.

16. The bow of claim 15, wherein the arrow support member is rotated to the first position when a force is applied to the thumb lever in the first direction.

17. The bow of claim 13, wherein the when the bowstring is drawn, a projection of the rotor removes the bar from the indent.

18. The bow of claim 17 wherein when the bowstring is released, the arrow support member is rotated in the second direction by a torsion spring.

19. The bow of claim 18, wherein the bar is urged into contact with the exterior surface of the rotor by a compression spring.

20. The bow of claim 19, wherein the arrow support member has extensions that extends away from the shaft and a roller rotatably connected on a first end of the roller to a first one of the extensions and on a second end of the roller to a second one of the pair of upright arms.

* * * * *